US010886650B1

(12) United States Patent
Komoto et al.

(10) Patent No.: US 10,886,650 B1
(45) **Date of Patent: *Jan. 5, 2021**

(54) CONNECTOR ADAPTED TO BE CONNECTED TO FLEXIBLE CONDUCTOR

(71) Applicant: Japan Aviation Electronics Industry, Limited, Tokyo (JP)

(72) Inventors: Tetsuya Komoto, Tokyo (JP); Seiya Matsuo, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/830,915

(22) Filed: Mar. 26, 2020

(30) Foreign Application Priority Data

Jul. 19, 2019 (JP) ..... 2019-133418

(51) Int. Cl.
*H01R 12/77* (2011.01)
*H01R 13/10* (2006.01)

(52) U.S. Cl.
CPC ..... *H01R 12/778* (2013.01); *H01R 12/771* (2013.01); *H01R 12/777* (2013.01); *H01R 13/10* (2013.01)

(58) Field of Classification Search
CPC ... A41D 1/005; H01R 13/2471; H01R 13/665
See application file for complete search history.

(56) References Cited

U.S. PATENT DOCUMENTS 9,893,478 B2 * 2/2018 Komoto ..... A41D 1/005
10,109,963 B2 * 10/2018 Komoto ..... H01R 24/005
(Continued)

FOREIGN PATENT DOCUMENTS

DE 20 2004 012418 U1 12/2005
EP 3361575 A1 8/2018
(Continued)

OTHER PUBLICATIONS

Extended European Search Report issued in corresponding EP application No. 20 17 2286 with a completion date of Oct. 6, 2020.

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A connector includes a pushing member having a projection, and a contact made of a conductive material and having a projection accommodating portion of recess shape into which the projection is to be inserted, the projection having a protruding portion that is situated in a lateral surface of the projection with protruding from the lateral surface of the projection and approaches an inner surface of the projection accommodating portion when the projection is inserted into the projection accommodating portion, and a gap forming portion that is situated in the lateral surface of the projection around the protruding portion and forms a predetermined gap between the gap forming portion and the inner surface of the projection accommodating portion when the projection is inserted into the projection accommodating portion, the predetermined gap being wider than a distance between the protruding portion and the inner surface of the projection accommodating portion.

19 Claims, 9 Drawing Sheets

(56) References Cited

U.S. PATENT DOCUMENTS

| | | | | |
|---|---|---|---|---|
| 10,498,097 | B2 * | 12/2019 | Komoto | H01R 13/502 |
| 2006/0148309 | A1 | 7/2006 | Sakurai et al. | |
| 2006/0280322 | A1 * | 12/2006 | Abe | H01R 13/24 381/300 |
| 2009/0088652 | A1 * | 4/2009 | Tremblay | A61B 5/6814 600/388 |
| 2017/0209738 | A1 * | 7/2017 | Brennan | G06K 9/00342 |
| 2017/0279230 | A1 * | 9/2017 | Komoto | H01R 13/73 |
| 2018/0212359 | A1 * | 7/2018 | Wei | A41D 1/005 |
| 2018/0233854 | A1 * | 8/2018 | Komoto | H01R 12/58 |

FOREIGN PATENT DOCUMENTS

| | | | | |
|---|---|---|---|---|
| EP | 3 376 601 | A1 | | 9/2018 |
| JP | 2005122901 | A | * | 5/2005 |
| JP | 2018129244 | A | | 8/2018 |

* cited by examiner

CONNECTOR ADAPTED TO BE CONNECTED TO FLEXIBLE CONDUCTOR

BACKGROUND OF THE INVENTION

The present invention relates to a connector, particularly to a connector adapted to be connected to a flexible conductor.

As a connector connected to a flexible conductor, for instance, JP 2018-129244 A discloses a connector shown in FIG. 19. This connector includes a contact 2 and a base member 3 that are disposed on the opposite sides across a flexible substrate 1 to sandwich the flexible substrate 1 therebetween.

A flexible conductor 4 is exposed on the flexible substrate 1 on the side facing the contact 2, the contact 2 has a projection accommodating portion 5 of concave shape formed to face the flexible conductor 4, and a projection 6 is formed on the base member 3 to project toward the bottom of the flexible substrate 1. When the projection 6 of the base member 3 is, together with the flexible substrate 1, inserted into the projection accommodating portion 5 of the contact 2 with the flexible substrate 1 being sandwiched between the projection 6 and the contact 2 such that the projection 6 is covered by the flexible substrate 1, the flexible substrate 1 is pressed against the inner surface of the projection accommodating portion 5 of the contact 2 by the projection 6, and the inner surface of the projection accommodating portion 5 makes contact with the flexible conductor 4 exposed on the surface of the flexible substrate 1 accordingly, whereby the contact 2 is electrically connected to the flexible conductor 4.

As shown in FIG. 20, the projection accommodating portion 5 of the contact 2 has an inner surface in the shape of a cylindrical tube, and as shown in FIG. 21, the projection 6 has the shape of a cylindrical column. When the projection 6 is, together with the flexible substrate 1, inserted into the projection accommodating portion 5 of the contact 2 with the flexible substrate 1 being sandwiched between the projection 6 and the contact 2, the flexible conductor 4 of the flexible substrate 1 is pressed against the inner surface of the projection accommodating portion 5 by the entire lateral surface of the projection 6 in the shape of a cylindrical column.

In this process, upon being press-fitted together with the projection 6 into the projection accommodating portion 5 of the contact 2, the flexible substrate 1 having the flexible conductor 4 is inserted into the projection accommodating portion 5 of the contact 2 while receiving a tensile force acting in all directions from the point of contact with the top of the projection 6 and thus being stretched.

However, when the flexible substrate 1 and the flexible conductor 4 do not have sufficient stretchability, redundant portions of the flexible substrate 1 and the flexible conductor 4 occur around the points in contact with the top of the projection 6 and are caught between the lateral surface of the projection 6 and the inner surface of the projection accommodating portion 5.

The presence of such redundant portions hinders the insertion of the projection 6 together with the flexible substrate 1 into the projection accommodating portion 5 of the contact 2, and this may make it difficult to smoothly connect the connector to the flexible substrate 1.

Furthermore, if the diameter of the projection 6 is set smaller in advance taking into account the possibility that redundant portions of the flexible substrate 1 and the flexible conductor 4 are caught between the lateral surface of the projection 6 and the inner surface of the projection accommodating portion 5, this may cause insufficient contact pressure of the flexible conductor 4 against the inner surface of the projection accommodating portion 5, thus impairing the reliability of electric connection between the flexible conductor 4 and the contact 2.

SUMMARY OF THE INVENTION

The present invention has been made to solve the foregoing problems and aims at providing a connector that can be smoothly connected to a flexible conductor regardless of the stretchability of the flexible conductor and can ensure the reliability of electric connection with the flexible conductor.

A connector according to the present invention is one adapted to be connected to a flexible conductor, the connector comprising:

a pushing member having a projection; and a contact made of a conductive material and having a projection accommodating portion of recess shape into which the projection is to be inserted, wherein the projection includes: a protruding portion that is situated in a lateral surface of the projection with protruding from the lateral surface of the projection and approaches an inner surface of the projection accommodating portion when the projection is inserted into the projection accommodating portion; and a gap forming portion that is situated in the lateral surface of the projection around the protruding portion and forms a predetermined gap between the gap forming portion and the inner surface of the projection accommodating portion when the projection is inserted into the projection accommodating portion, the predetermined gap being wider than a distance between the protruding portion and the inner surface of the projection accommodating portion, and wherein when the projection of the pushing member is inserted in the projection accommodating portion of the contact together with the flexible conductor with the flexible conductor being sandwiched between the projection and the projection accommodating portion of the contact such that the projection of the pushing member is covered by the flexible conductor, the protruding portion of the projection presses the flexible conductor against the inner surface of the projection accommodating portion to contact the flexible conductor to the inner surface of the projection accommodating portion, and a redundant portion of the flexible conductor generated upon being inserted into the projection accommodating portion is received in the predetermined gap.

DETAILED DESCRIPTION OF THE INVENTION

Embodiments of the present invention are described below with reference to the accompanying drawings.

Embodiment 1

Figure 1:
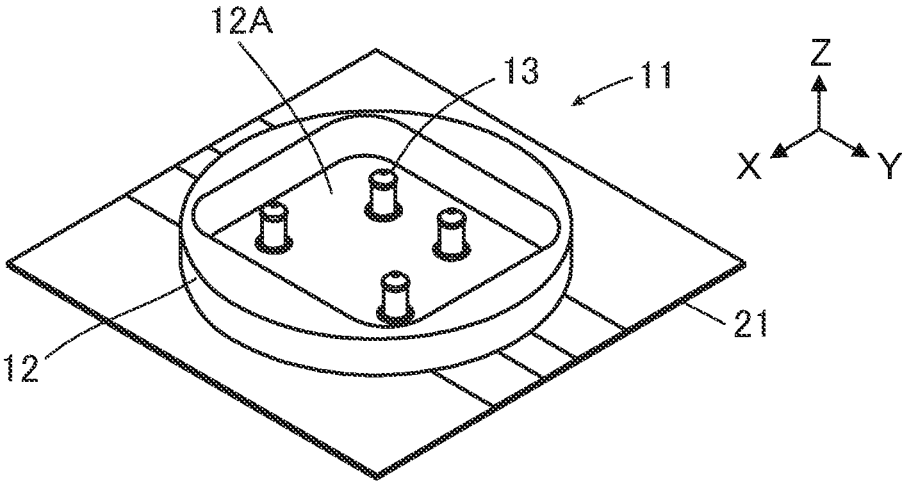
FIG. 1 is a perspective view showing a connector according to Embodiment 1 of the present invention.
Figure 2:
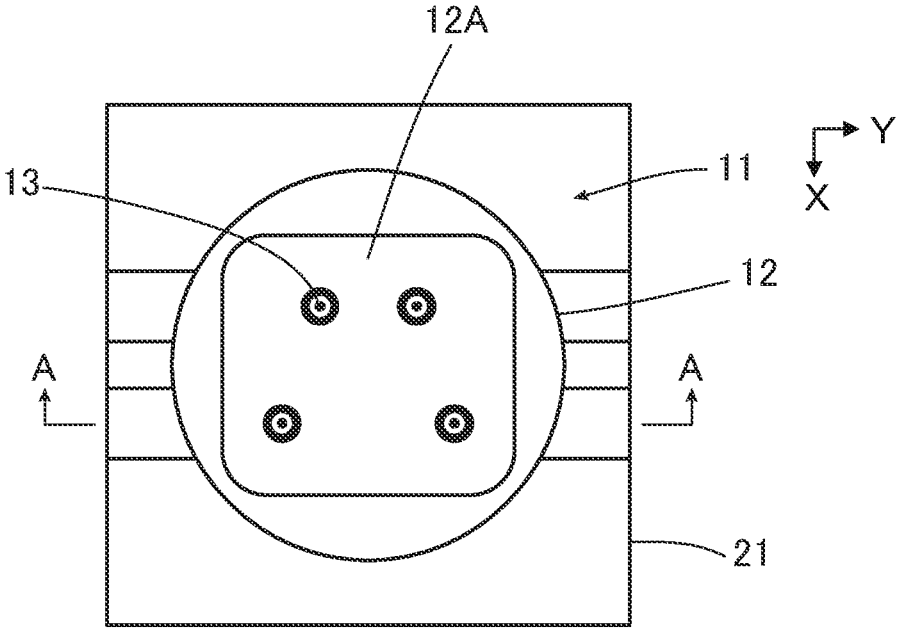
FIG. 2 is a plan view showing the connector according to Embodiment 1.

FIGS. 1 and 2 show a connector 11 according to Embodiment 1. The connector 11 is used as, for example, a garment-side connector portion for fitting a wearable device, and is connected to a flexible substrate 21.

The connector 11 includes a housing 12 disposed on the flexible substrate 21, and four contacts 13. The housing 12 has a recess 12A within which the four contacts 13 project perpendicularly to the flexible substrate 21.

For convenience, the flexible substrate 21 is defined as extending along an XY plane, and the direction in which the contacts 13 project is referred to as "+Z direction."

Figure 3:
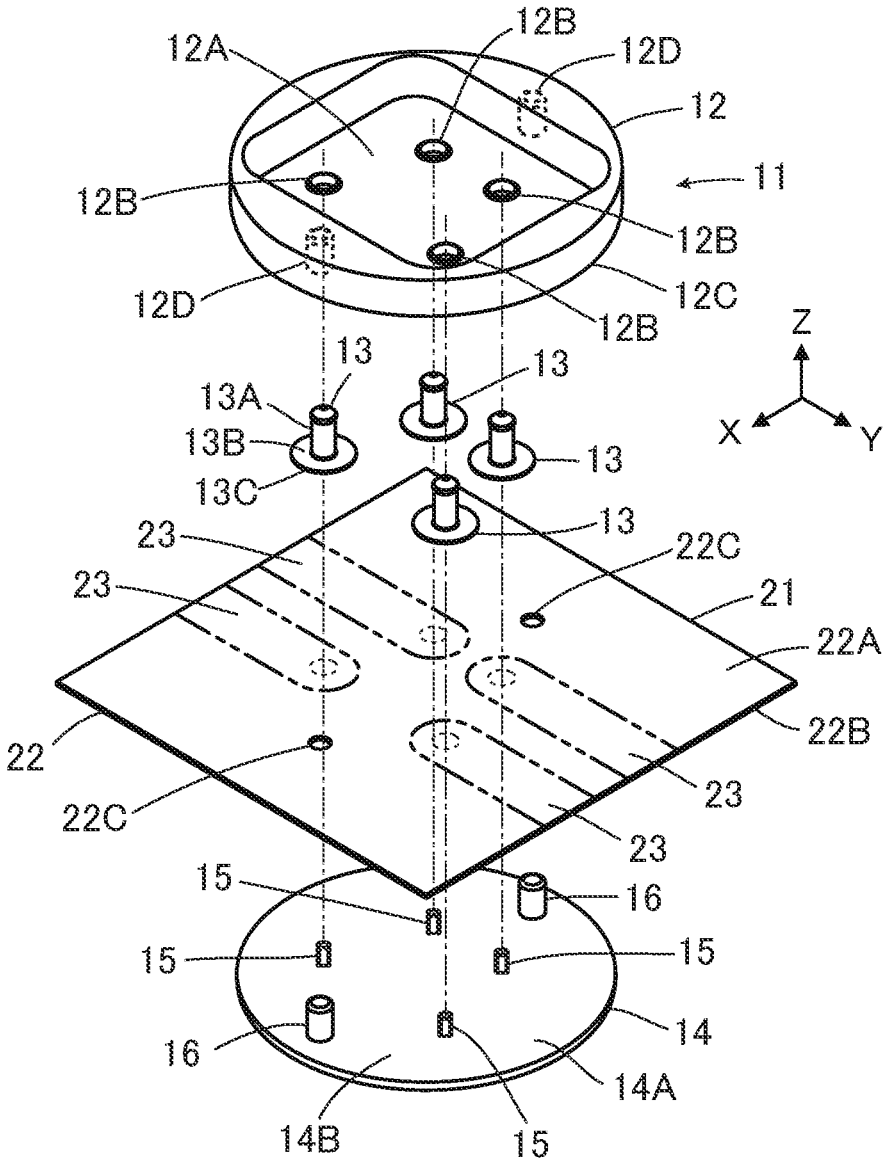
FIG. 3 is an exploded perspective view of the connector according to Embodiment 1.

As shown in FIG. 3, the connector 11 further includes, as a pushing member, a base member 14 disposed on the −Z direction side of the flexible substrate 21, and the connector 11 is connected to the flexible substrate 21 with the flexible substrate 21 being sandwiched between the housing 12 and the base member 14.

The flexible substrate 21 includes a sheet-type substrate body 22 made of an insulating material, and the substrate body 22 has a top surface 22A facing in the +Z direction and a bottom surface 22B facing in the −Z direction. Four flexible conductors 23 are disposed to be exposed on the top surface 22A of the substrate body 22. The four flexible conductors 23 correspond to the four contacts 13 on a one-to-one basis.

The flexible conductors 23 may be made of, for instance, a cloth-type conductor such as conductive fiber, or conductive paste applied onto the top surface 22A of the substrate body 22 by printing or another method.

The substrate body 22 is provided with two through-holes 22C.

The housing 12 is made of an insulating material such as insulating resin and is provided with four contact through-holes 12B within the recess 12A opening in the +Z direction. The recess 12A constitutes a counter connector accommodating portion in which a part of a counter connector (not shown) is to be accommodated. The four contact through-holes 12B correspond to the four contacts 13 on a one-to-one basis. Two recessed post accommodating portions 12D are formed in positions outside the recess 12A in the XY direction and at a surface 12C of the housing 12 on the −Z direction side.

The four contacts 13 are plug-type contacts made of a conductive material such as metal, and are to be connected to corresponding contacts of a counter connector (not shown) when a part of the counter connector is accommodated in the recess 12A of the housing 12. Each contact 13 has a tubular portion 13A having the shape of a cylindrical tube extending in the Z direction and a contact-side flange 13B extending from the −Z directional end of the tubular portion 13A along an XY plane. The contact-side flange 13B has a second surface 13C facing in the −Z direction.

The base member 14 is made of an insulating material such as insulating resin and has a flat plate portion 14A. The flat plate portion 14A has a first surface 14B facing in the +Z direction. Four projections 15 project on the first surface 14B. In addition, two housing fixing posts 16 larger in height than the projections 15 project from the first surface 14B of the flat plate portion 14A.

As shown in FIG. 3, each of the four contact through-holes 12B of the housing 12, each of the four flexible conductors 23 of the flexible substrate 21, and each of the four projections 15 of the base member 14 are arranged to correspond to each other in position.

Similarly, each of the two post accommodating portions 12D of the housing 12, each of the two through-holes 22C of the substrate body 22 of the flexible substrate 21, and each of the two housing fixing posts 16 of the base member 14 are arranged to correspond to each other in position.

The through-holes 22C of the substrate body 22 of the flexible substrate 21 have an inside diameter slightly larger than the outside diameter of the housing fixing posts 16 of the base member 14 to allow smooth insertion of the housing fixing posts 16. Further, the post accommodating portions 12D of the housing 12 have an inside diameter slightly smaller than the outside diameter of the housing fixing posts 16 of the base member 14, so that when the housing fixing posts 16 are press-fitted into the post accommodating portions 12D, the housing 12 and the base member 14 are fixed to each other.

The contact through-holes 12B of the housing 12 have an inside diameter larger than the outside diameter of the tubular portions 13A of the contacts 13 and smaller than the outside diameter of the contact-side flanges 13B thereof, thus allowing smooth insertion of the tubular portions 13A of the contacts 13.

Figure 4:
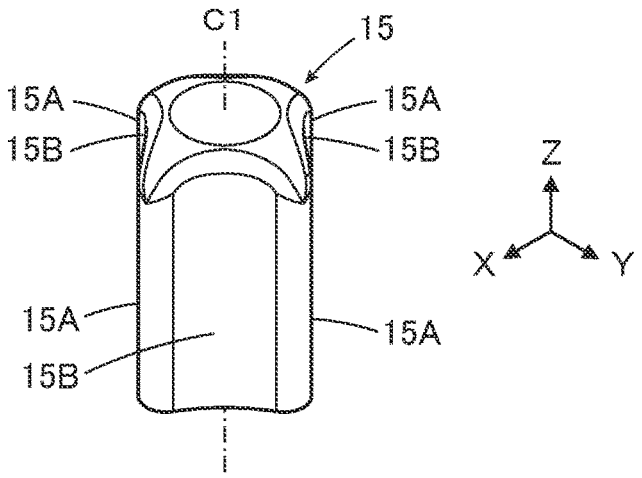
FIG. 4 is a perspective view showing a projection used in the connector according to Embodiment 1.

As shown in FIG. 4, each projection 15 of the base member 14 has a central axis C1 extending in the Z direction and extend in the Z direction along the central axis C1. The projection 15 is in the shape of a substantially square prism and has four protruding portions 15A linearly extending in parallel with the central axis C1. The four protruding portions 15A correspond to four parallel sides of the substantially square prism that form the projection 15. The four protruding portions 15A are arranged at equal intervals in the circumferential direction of the projection 15 and protrude separately in the +X direction, −X direction, +Y direction and −Y direction.

Four gap forming portions 15B dented toward the central axis C1 are each formed between every two adjacent protruding portions 15A. While the four gap forming portions 15B are equivalent to four lateral surfaces of the substantially square prism that form the projection 15, each of the gap forming portions 15B has not a flat surface but a curved concave surface.

Figure 5:
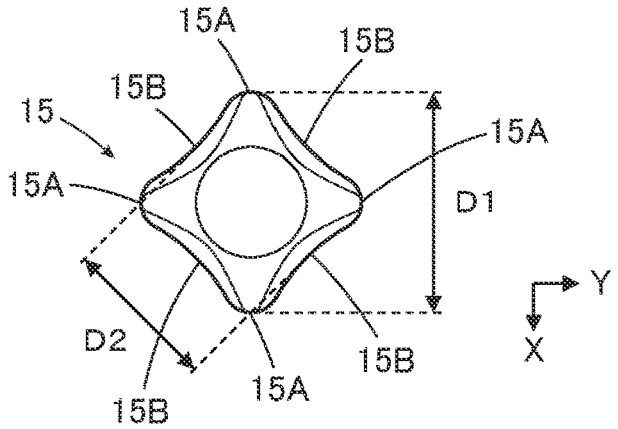
FIG. 5 is a plan view showing the projection used in the connector according to Embodiment 1.

As shown in FIG. 5, a length D1 between, of the four protruding portions 15A, two protruding portions 15A protruding in the opposite directions from each other is larger than a length D2 between two gap forming portions 15B facing in the opposite directions from each other with respect to the central axis C1.

Figure 6:
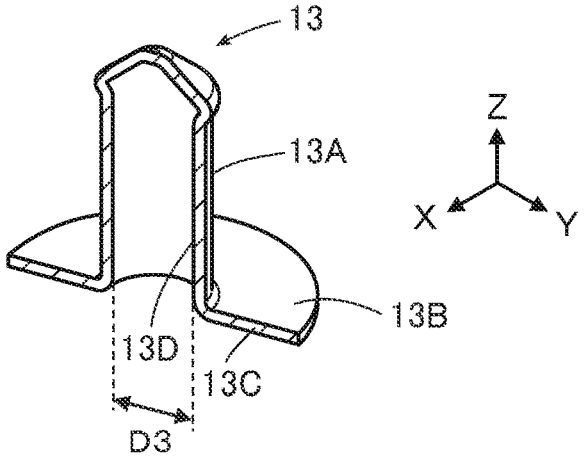
FIG. 6 is a cross-sectional perspective view showing a contact used in the connector according to Embodiment 1.

As shown in FIG. 6, the tubular portion 13A of the contact 13 has the shape of a cylindrical tube with its +Z directional end being closed, the contact-side flange 13B is formed integrally with the −Z directional end of the tubular portion 13A, and a projection accommodating portion 13D of recess shape is provided in the second surface 13C of the contact-side flange 13B facing in the −Z direction. Specifically, the projection accommodating portion 13D is formed inside the tubular portion 13A so as to have an opening end at the second surface 13C of the contact-side flange 13B.

The projection accommodating portion 13D of the contact 13 has an inside diameter smaller than a value obtained by adding a double of the sum of the thickness of the substrate body 22 of the flexible substrate 21 and the thickness of the flexible conductor 23 to the length D1 between, of the four protruding portions 15A of the projection 15 of the base member 14, two protruding portions 15A protruding in the opposite directions from each other with respect to the central axis C1. The contact 13 as above can be manufactured by, for example, press working, cutting or cold heading.

When the connector 11 is connected to the flexible substrate 21, first, in FIG. 3, the two housing fixing posts 16 of the base member 14 are separately inserted into the two through-holes 22C so as to project above the top surface 22A of the substrate body 22 of the flexible substrate 21, the tubular portions 13A of the four contacts 13 are separately inserted into the four contact through-holes 12B of the housing 12 from the −Z direction side, and the tips of the two housing fixing posts 16 of the base member 14 projecting above the top surface 22A of the substrate body 22 of the flexible substrate 21 are separately inserted into the two post accommodating portions 12D of the housing 12. As a result, the housing 12, the four contacts 13, the flexible substrate 21 and the base member 14 are aligned with each other in the XY direction.

Since the housing fixing posts 16 of the base member 14 are larger in height than the projections 15, the housing fixing posts 16 are inserted into the through-holes 22C of the substrate body 22 of the flexible substrate 21 without being affected by the presence of the projections 15.

In this state, when the housing 12 and the base member 14 are pressed against each other in the Z direction to approach each other, the surface 12C of the housing 12 on the −Z direction side and the second surfaces 13C of the four contacts 13 facing in the −Z direction come into contact with the top surface 22A of the substrate body 22, while the four projections 15 of the base member 14 come into contact with the bottom surface 22B of the substrate body 22 and subsequently push the contacted portions of the flexible substrate 21 in the +Z direction.

Figure 7:
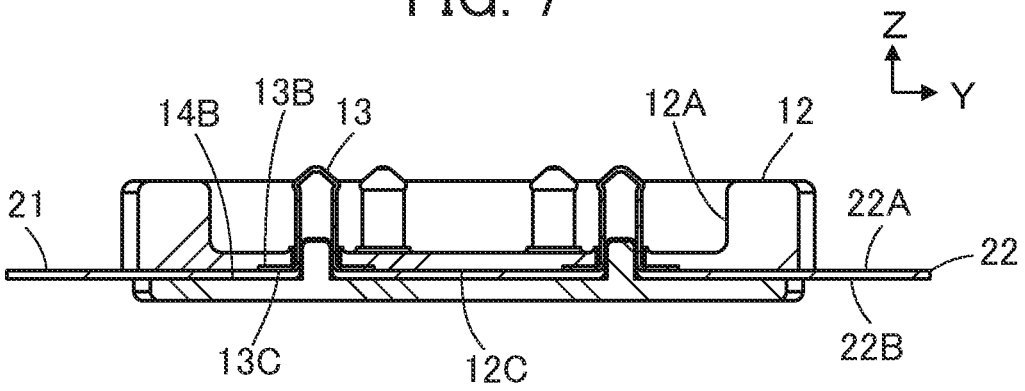
FIG. 7 is a cross-sectional view taken along line A-A in FIG. 2.

As a result, as shown in FIG. 7, the projections 15 of the base member 14 are inserted in the projection accommodating portions 13D of the corresponding contacts 13 with the flexible substrate 21 being sandwiched therebetween, and the first surface 14B of the base member 14 facing in the +Z direction is in contact with the bottom surface 22B of the substrate body 22.

In this state, since the contact through-holes 12B of the housing 12 have an inside diameter larger than the outside diameter of the tubular portions 13A of the contacts 13 and smaller than the outside diameter of the contact-side flanges 13B thereof as shown in FIG. 3, the contact-side flange 13B of each contact 13 is sandwiched between the surface 12C of the housing 12 on the −Z direction side and the flexible conductor 23 disposed on the top surface 22A of the substrate body 22 of the flexible substrate 21, whereby the contacts 13 are fixed relative to the base member 14. Further, the housing 12 and the base member 14 are fixed to each other by press-fitting the two housing fixing posts 16 of the base member 14 into the two post accommodating portions 12D of the housing 12, and thus the process for connecting the connector 11 to the flexible substrate 21 is completed.

When the connector 11 is connected to the flexible substrate 21 as described above, the projections 15 of the base member 14 are inserted into the projection accommodating portions 13D of the corresponding contacts 13 with the surfaces of the projections 15 being covered by the flexible substrate 21. Accordingly, the substrate body 22 of the flexible substrate 21 and the flexible conductors 23 disposed on the top surface 22A of the substrate body 22 are pushed in the Z direction toward the projection accommodating portions 13D by the projections 15 and thereby deform, whereupon the flexible conductors 23 make contact with the inner surfaces of the projection accommodating portions 13D of the corresponding contacts 13 in the direction parallel to the second surface 13C of the contact 13, i.e., the direction along an XY plane.

Figure 8:
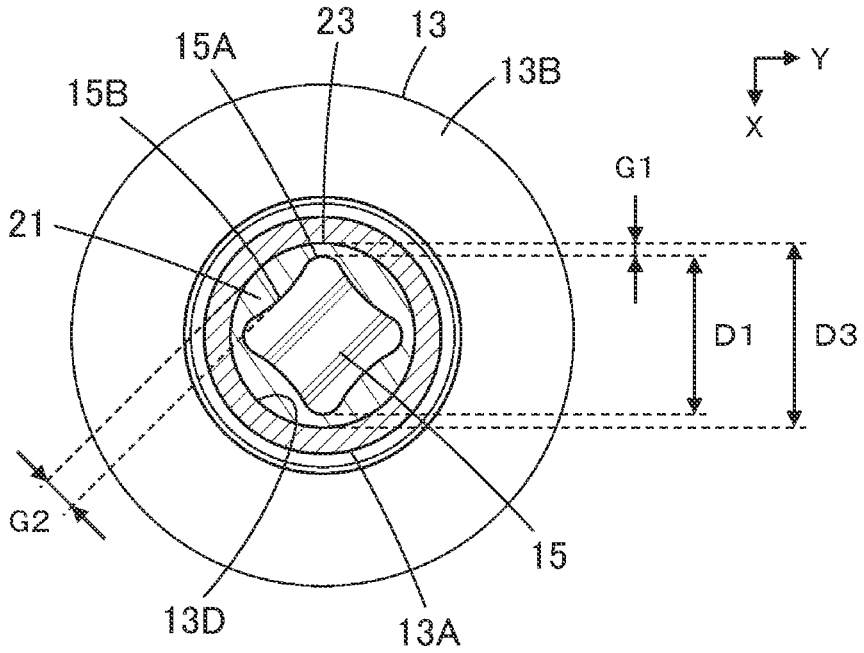
FIG. 8 is a cross-sectional plan view showing the projection and a flexible conductor accommodated in a projection accommodating portion of the contact in Embodiment 1.

At this time, as shown in FIG. 8, since the projection accommodating portion 13D of the contact 13 has an inside diameter D3 smaller than the value obtained by adding a double of the sum of the thickness of the substrate body 22 of the flexible substrate 21 and the thickness of the flexible conductor 23 to the length D1 between two protruding portions 15A of the projection 15 protruding in the opposite directions from each other, the four protruding portions 15A of the projection 15 are allowed to press the flexible conductor 23 against the inner surface of the projection accommodating portion 13D of the contact 13 and thus apply contact pressures, so that the contact 13 is electrically connected to the flexible conductor 23.

Further, when the substrate body 22 of the flexible substrate 21 and the flexible conductors 23 disposed on the top surface 22A of the substrate body 22 are inserted into the projection accommodating portions 13D by the projections 15, if the flexible substrate 21 does not have sufficient stretchability, the substrate body 22 and the flexible conductors 23 deform around the points in contact with the tops of the projections 15, and the deformation leads to redundant portions that may be folded and result in creases.

However, as shown in FIG. 5, the four gap forming portions 15B are each formed between every two adjacent protruding portions 15A of the projection 15, and the length D2 between two gap forming portions 15B facing in the opposite directions from each other is smaller than the length D1 between two protruding portions 15A protruding in the opposite directions from each other. Therefore, as shown in FIG. 8, when the projection 15 is inserted in the projection accommodating portion 13D of the contact 13, a predetermined gap G2 wider than a distance G1 between each protruding portion 15A and the inner surface of the projection accommodating portion 13D is formed between each gap forming portion 15B and the inner surface of the projection accommodating portion 13D.

Thus, the predetermined gaps G2 formed between the four gap forming portions 15B of the projection 15 and the inner surface of the projection accommodating portion 13D of the contact 13 can receive the redundant portions having occurred in the substrate body 22 and the flexible conductor 23. The redundant portions of the substrate body 22 and the flexible conductor 23 are to be received in the predetermined gaps G2 while being pressed against the inner surface of the projection accommodating portion 13D with forces weaker than pressing forces of the protruding portions 15A of the projection 15 or without being affected by any pressing force against the inner surface of the projection accommodating portion 13D.

As a result, even when the substrate body 22 of the flexible substrate 21 and the flexible conductors 23 do not have sufficient stretchability, the projections 15 of the base member 14 can be smoothly inserted into the projection accommodating portions 13D of the contacts 13 with the flexible substrate 21 being sandwiched therebetween so as to connect the connector 11 to the flexible substrate 21, and the reliability of the electrical connection with the flexible conductors 23 can be ensured.

Embodiment 2

In Embodiment 1 above, the substrate body 22 of the flexible substrate 21 and the flexible conductors 23 disposed on the top surface 22A of the substrate body 22 are inserted into the projection accommodating portions 13D of the contacts 13 by the projections 15; however, the invention is not limited thereto.

Figure 9:
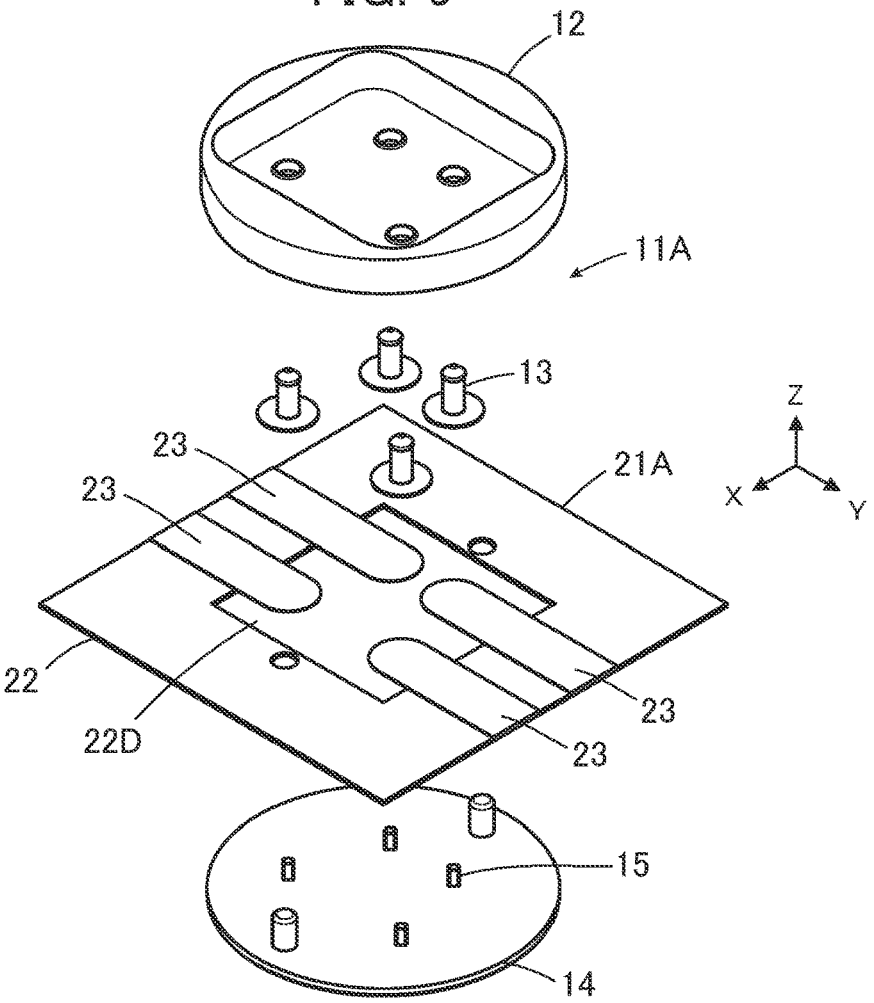
FIG. 9 is an exploded perspective view of a connector according to Embodiment 2.

FIG. 9 shows an exploded perspective view of a connector 11A according to Embodiment 2. The connector 11A is connected to a flexible substrate 21A and has the same configuration as the connector 11 of Embodiment 1 except that the size of the projections 15 of the base member 14 relative to the inside diameter of the projection accommodating portions 13D of the contacts 13 is changed. Specifically, the connector 11A includes the housing 12, the four contacts 13, and the base member 14 having the four projections 15 projecting thereon.

While the flexible substrate 21A to which the connector 11A is connected includes the sheet-type substrate body 22 made of an insulating material and the four flexible conductors 23, the substrate body 22 has an opening 22D penetrating the substrate body 22, and the four flexible conductors 23 are held on the top surface 22A of the substrate body 22 such that their tips project to the inside of the opening 22D of the substrate body 22.

Figure 10:
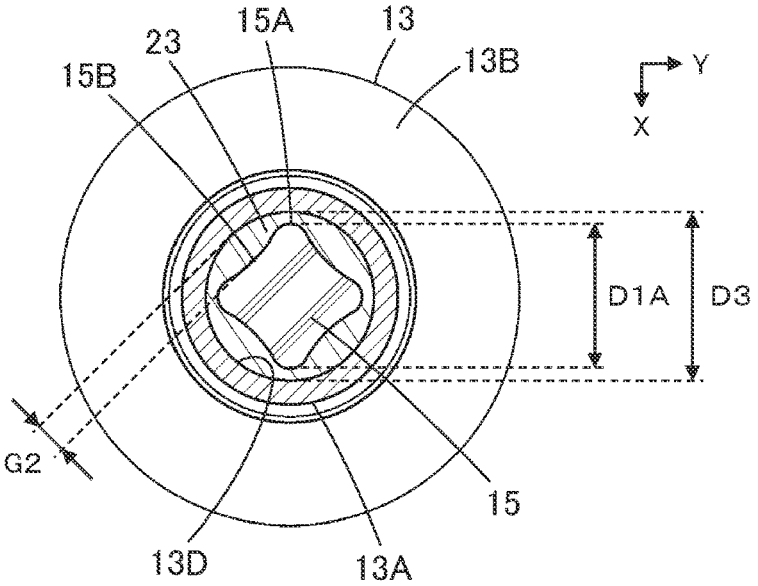
FIG. 10 is a cross-sectional plan view showing a projection and a flexible conductor accommodated in a projection accommodating portion of a contact in Embodiment 2.

The four flexible conductors 23 are made of, for example, conductive fiber and as shown in FIG. 10, each inserted into the projection accommodating portion 13D of the corresponding contact 13 by the corresponding projection 15 within the opening 22D of the substrate body 22.

The projection accommodating portion 13D of the contact 13 has an inside diameter D3 smaller than a value obtained by adding a double of the thickness of the flexible conductor 23 to a length D1A between two protruding portions 15A of the projection 15 protruding in the opposite directions from each other. In other words, the length D1A between two protruding portions 15A of the projection 15 protruding in the opposite directions from each other in the connector 11A of Embodiment 2 is set to be larger than a value obtained by subtracting a double of the thickness of the flexible conductor 23 from the inside diameter D3 of the projection accommodating portion 13D of the contact 13.

This configuration allows the four protruding portions 15A of the projection 15 to press the flexible conductor 23 against the inner surface of the projection accommodating portion 13D of the contact 13 and thus apply contact pressures, so that the contact 13 is electrically connected to the flexible conductor 23.

Also in Embodiment 2, when each flexible conductor 23 is inserted into the corresponding projection accommodating portion 13D by the corresponding projection 15, redundant portions of the flexible conductor 23 may be generated around the point in contact with the top of the projection 15; however, the predetermined gaps G2 formed between the four gap forming portions 15B of the projection 15 and the inner surface of the projection accommodating portion 13D of the corresponding contact 13 can receive the redundant portions.

As a result, even when the flexible conductors 23 do not have sufficient stretchability, the projections 15 of the base member 14 can be smoothly inserted into the projection accommodating portions 13D of the contacts 13 with the flexible conductors 23 being sandwiched therebetween so as to connect the connector 11 to the flexible substrate 21A, and the reliability of the electrical connection with the flexible conductors 23 can be ensured.

Figure 11:
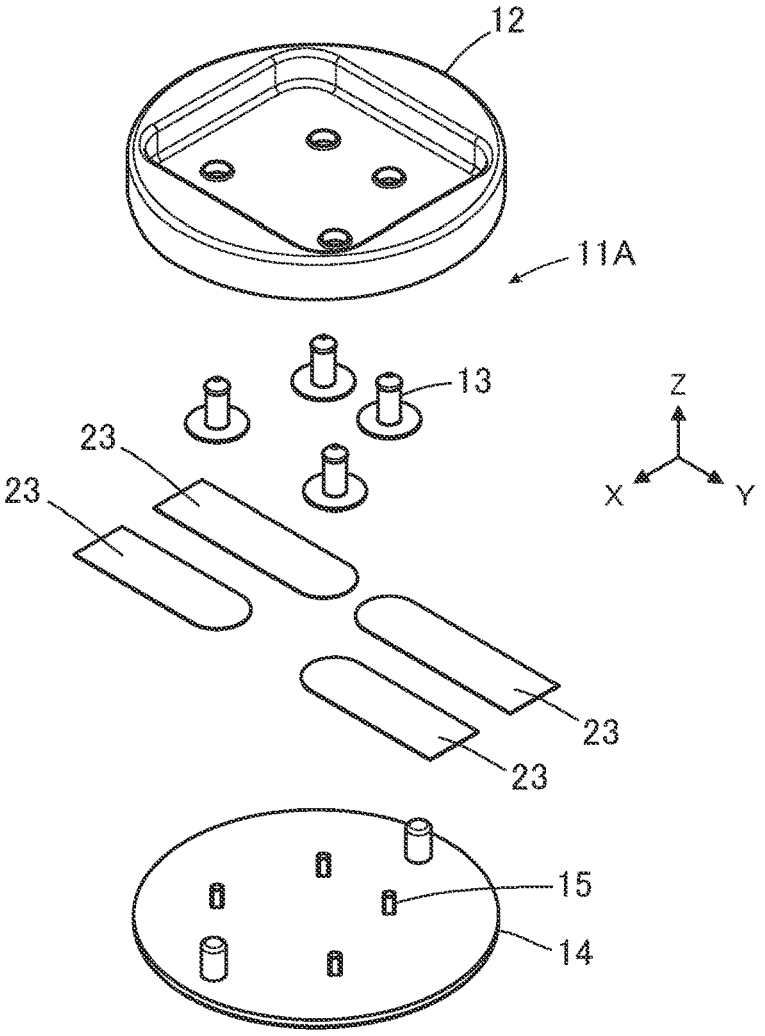
FIG. 11 is an exploded perspective view of a connector according to a modification of Embodiment 2.

Furthermore, the connector 11A according to Embodiment 2 can be connected to the four flexible conductors 23 that are not held by the substrate body 22 and are thus independent as shown in FIG. 11. Also in this case, the four flexible conductors 23 are each inserted into the projection accommodating portion 13D of the corresponding contact 13 by the corresponding projection 15 of the base member 14 and as shown in FIG. 10, pressed against the inner surface of the projection accommodating portion 13D by the four protruding portions 15A of the projection 15, while redundant portions of each flexible conductor 23 are received in the predetermined gaps G2 formed between the four gap forming portions 15B of the projection 15 and the inner surface of the projection accommodating portion 13D of the contact 13.

While the four contacts 13 are used in Embodiments 1 and 2 above, it suffices if at least one contact 13 is provided. Regardless of the number of the contacts 13, all of the contacts 13 can be simultaneously fitted with the corresponding projections 15 of the base member 14 by pressing the housing 12 and the base member 14 so that they approach each other with the flexible substrate 21, 21A or the flexible conductors 23 being sandwiched therebetween, and therefore, even when the connector is a multi-contact connector having a plurality of contacts 13, it is possible to achieve easy connection to and reliable electrical connection with the flexible substrate 21, 21A or the flexible conductors 23.

While in Embodiments 1 and 2 above, the projection 15 of the base member 14 has the four protruding portions 15A arranged at equal intervals in the circumferential direction and the four gap forming portions 15B each formed between every two adjacent protruding portions 15A, the invention is not limited thereto, and the projection 15 may have one or more protruding portions 15A and one or more gap forming portions 15B.

For instance, the projection 15 may have two protruding portions 15A protruding in the opposite directions with respect to the central axis C1 and two gap forming portions 15B each formed between the two protruding portions 15A. Alternatively, the projection 15 may have three protruding portions 15A arranged about the central axis C1 at 120 degree intervals in the circumferential direction and three gap forming portions 15B each formed between every two adjacent protruding portions 15A.

When the projection as above is inserted into the projection accommodating portion 13D of cylindrical tube shape of the contact 13 such that the central axis C1 of the projection coincides with the central axis of the projection accommodating portion 13D, it is preferable that the distance dimension between each protruding portion 15A of the projection and the inner surface of the projection accommodating portion 13D be smaller than the thickness dimension of the flexible substrate 21 or the flexible conductor 23 sandwiched between the projection and the projection accommodating portion 13D. With this configuration, the flexible conductor 23 can be pressed against the inner surface of the projection accommodating portion 13D with predetermined contact pressures, thus making it possible to establish reliable electric connection between the contact 13 and the flexible conductor 23.

Embodiment 3

Figure 12:
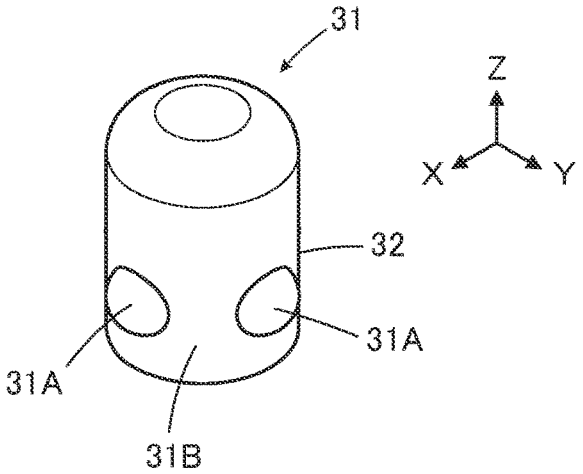
FIG. 12 is a perspective view showing a projection used in a connector according to Embodiment 3.
Figure 13:
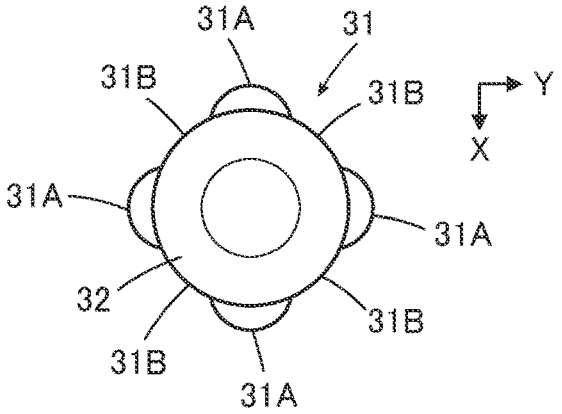
FIG. 13 is a plan view showing the projection used in the connector according to Embodiment 3.

While in Embodiments 1 and 2, the projection 15 of the base member 14 has the four protruding portions 15A linearly extending in parallel with the central axis C1 of the projection 15 and the four gap forming portions 15B each formed between every two adjacent protruding portions 15A, there may be used a projection 31 having four protruding portions 31A in a spherical shape as shown in FIGS. 12 and 13.

The four protruding portions 31A are formed near the root portion of a cylindrical projection body 32 to protrude from the lateral surface of the projection body 32 and are arranged at equal intervals in the circumferential direction of the projection body 32.

The lateral surface of the cylindrical projection body 32 around the protruding portions 31A forms gap forming portions 31B.

When the projection 31 is inserted into the projection accommodating portion 13D of the contact 13, the four protruding portions 31A separately approach the inner surface of the projection accommodating portion 13D, and a predetermined gap wider than a distance between each protruding portion 31A and the inner surface of the projection accommodating portion 13D is formed between each gap forming portion 31B and the inner surface of the projection accommodating portion 13D.

Even with the thus configured projections 31, as with Embodiments 1 and 2, when the projections 31 are inserted into the projection accommodating portions 13D of the contacts 13 with the flexible substrate 21 having the flexible conductors 23 exposed on its surface or the independent flexible conductors 23 being sandwiched therebetween, the contacts 13 can be electrically connected to the flexible conductors 23, and redundant portions of the flexible substrate 21 or each flexible conductor 23 generated upon its deformation can be received in the predetermined gaps between the gap forming portions 31B of the corresponding projection 31 and the inner surface of the projection accommodating portion 13D of the corresponding contact 13.

The numbers of the protruding portions 31A and the gap forming portions 31B of the projection 31 are not limited also in Embodiment 3, and the projection 31 may have one or more protruding portions 31A and one or more gap forming portions 31B.

Embodiment 4

Figure 14:
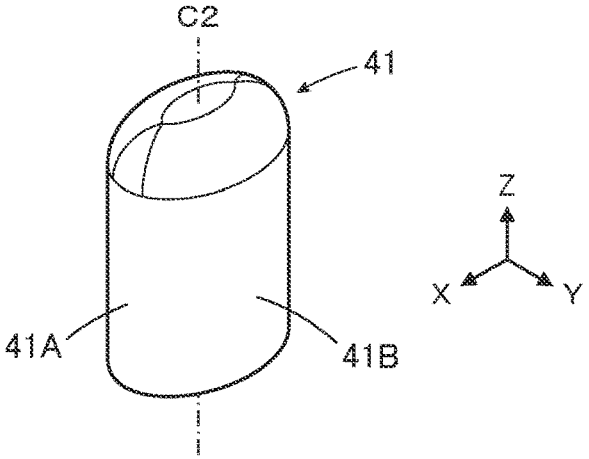
FIG. 14 is a perspective view showing a projection used in a connector according to Embodiment 4.
Figure 15:
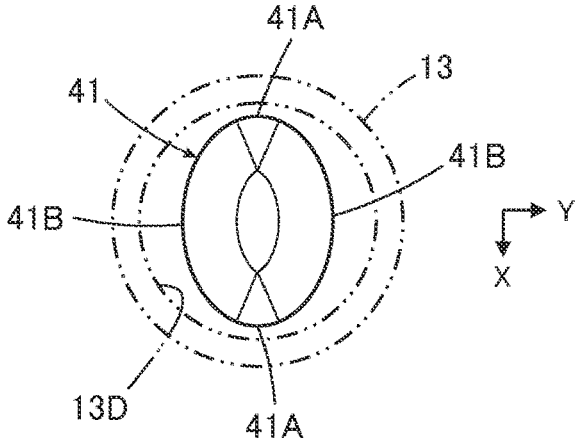
FIG. 15 is a plan view showing the projection used in the connector according to Embodiment 4.

Alternatively, a projection 41 shown in FIGS. 14 and 15 may be used.

The projection 41 is in the shape of an elliptic cylinder having a central axis C2 extending in the Z direction and with a major axis extending in the X direction and a minor axis extending in the Y direction in a cross section along an XY plane.

Two protruding portions 41A are formed from portions of the lateral surface of the projection 41 situated in the major axis direction of the ellipse, i.e., the +X directional end and the −X directional end of the lateral surface of the projection 41, while gap forming portions 41B are formed from the remaining portions of the lateral surface.

As shown in FIG. 15, when the projection 41 is inserted into the projection accommodating portion 13D of the contact 13, the two protruding portions 41A separately approach the inner surface of the projection accommodating portion 13D, and a predetermined gap wider than a distance between each protruding portion 41A and the inner surface of the projection accommodating portion 13D is formed between each gap forming portion 41B and the inner surface of the projection accommodating portion 13D. In particular, gaps between the gap forming portions 41B and the inner surface of the projection accommodating portion 13D are maximum at the points of the lateral surface of the projection 41 situated in the minor axis direction of the ellipse, i.e., the +Y directional end and the −Y directional end of the lateral surface of the projection 41.

Even with the projections 41 as above, when the projections 41 are inserted into the projection accommodating portions 13D of the contacts 13 with the flexible substrate 21 having the flexible conductors 23 exposed on its surface or the independent flexible conductors 23 being sandwiched therebetween, the contacts 13 can be electrically connected to the flexible conductors 23, and redundant portions of the flexible substrate 21 or each flexible conductor 23 generated upon its deformation can be received in the predetermined gaps between the gap forming portions 41B of the corresponding projection 41 and the inner surface of the projection accommodating portion 13D of the corresponding contact 13.

Embodiment 5

Figure 16:
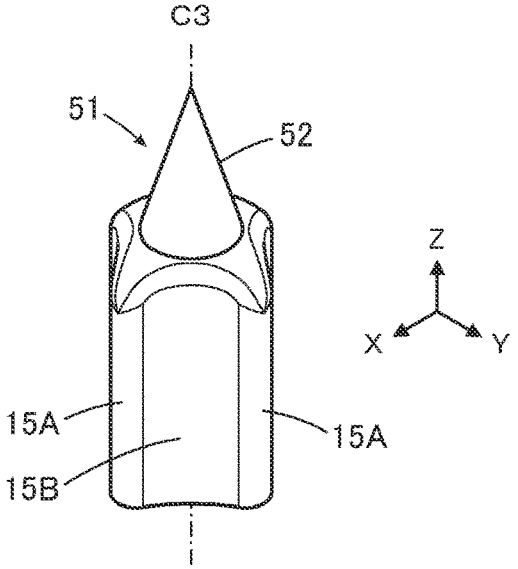
FIG. 16 is a perspective view showing a projection used in a connector according to Embodiment 5.
Figure 17:
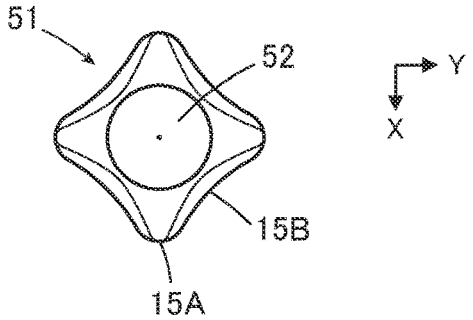
FIG. 17 is a plan view showing the projection used in the connector according to Embodiment 5.

In place of the projection 15 in Embodiments 1 and 2, a projection 51 shown in FIGS. 16 and 17 may be used. The projection 51 is made by providing a pointed portion 52 at the top of the projection 15 shown in FIG. 4, i.e., at the tip thereof in the +Z direction, and otherwise has the same configuration as the projection 15.

The projection 51 has a central axis C3 extending in the Z direction, and has four protruding portions 15A linearly extending in parallel with the central axis C3 and the four gap forming portions 15B each formed between every two adjacent protruding portions 15A.

The pointed portion 52 is provided to pierce the flexible substrate 21 having the flexible conductor 23 exposed on its surface or the independent flexible conductor 23 when inserted into the projection accommodating portion 13D of the contact 13 together with the flexible substrate 21 or the flexible conductor 23. The pointed portion 52 has a conical shape extending in the +Z direction along the central axis C3 and sharply pointed in the +Z direction.

When the projection 51 is inserted into the projection accommodating portion 13D of the contact 13 with the surface of the projection 51 being covered by the flexible substrate 21 having the flexible conductor 23 exposed on its surface or the independent flexible conductor 23, the flexible substrate 21 or the flexible conductor 23 is pierced to open by the pointed portion 52 of the projection 51, and the projection 51 projects through the opened portion toward the +Z direction side of the flexible substrate 21 or the flexible conductor 23, thus allowing the edge of the opened portion of the flexible substrate 21 or the flexible conductor 23 to conform with the lateral surface of the projection 51.

Accordingly, the protruding portions 15A of the projection 51 press the flexible conductor 23 on the flexible substrate 21 or the independent flexible conductor 23 against the inner surface of the projection accommodating portion 13D of the contact 13, whereby the contact 13 is electrically connected to the flexible conductor 23.

In this manner, an opening is made in the flexible substrate 21 or the flexible conductor 23 using the pointed portion 52 of the projection 51, and the edge of the opened portion of the flexible substrate 21 or the flexible conductor 23 is sandwiched between the protruding portions 15A of the projection 51 and the inner surface of the projection accommodating portion 13D. Owing to this configuration, even when the flexible substrate 21 or the flexible conductor 23 is made of a material that is not very stretchable, the contact 13 can be electrically connected to the flexible conductor 23 without fail.

A pointed portion similar to the pointed portion 52 of the projection 51 may be provided at each of the +Z directional top of the projection 31 in Embodiment 3 and the +Z directional top of the projection 41 in Embodiment 4.

While the pointed portion 52 of the projection 51 has a conical shape, instead of the conical shape, the pointed portion 52 may be configured to have a linear blade extending toward the +Z direction to cut the flexible substrate 21 or the flexible conductor 23.

Embodiment 6

Figure 18:
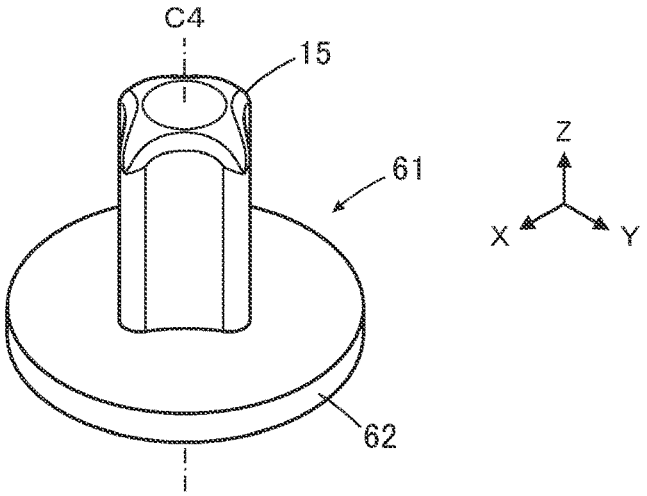
FIG. 18 is a perspective view showing a pushing member used in a connector according to Embodiment 6.
Figure 19:
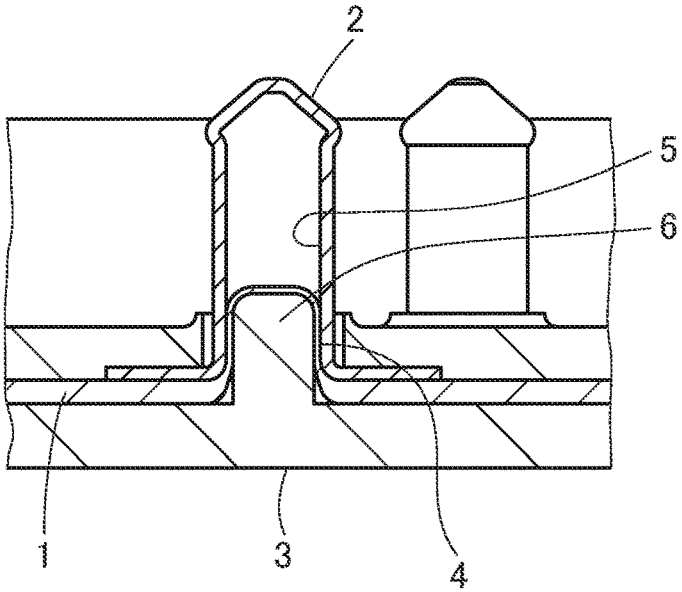
FIG. 19 PRIOR ART
FIG. 19 is a cross-sectional view showing a contact, a projection and a flexible substrate in a conventional connector.
Figure 20:
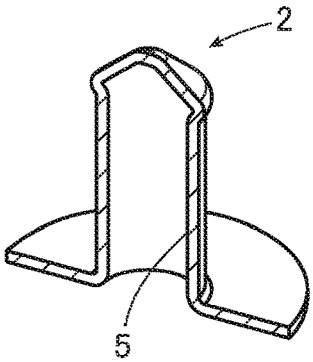
FIG. 20 PRIOR ART
FIG. 20 is a cross-sectional perspective view showing the contact in the conventional connector.
Figure 21:
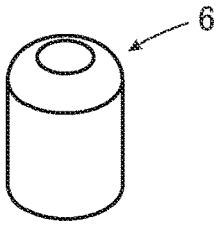
FIG. 21 PRIOR ART
FIG. 21 is a perspective view showing the projection in the conventional connector.

While in Embodiments 1 and 2, the base member 14 having the four projections 15 is used as a pushing member for pushing the projections 15 into the projection accommodating portions 13D of the contacts 13, the invention is not limited thereto, and as shown in FIG. 18, a pushing member 61 in which a pushing member-side flange 62 is joined to the root portion of a single projection 15 may also be used.

When the projection 15 of the pushing member 61 as above is inserted into the projection accommodating portion 13D of the corresponding contact 13 with the surface of the projection 15 of the pushing member 61 being covered by the flexible substrate 21 or the independent flexible conductor 23, the contact 13 can be electrically connected to the flexible conductor 23 on the flexible substrate 21 or the independent flexible conductor 23.

For the projections 31, 41 and 51 in Embodiments 3, 4 and 5, similarly, a pushing member in which a pushing member-side flange is joined to the root portion of a single projection may be formed.

While the plug-type contacts 13 are used in Embodiments 1 to 6 above, the invention is not limited thereto, and a connector may be configured such that receptacle-type contacts are connected to the flexible conductors 23 on the flexible substrate 21 or the independent flexible conductors 23 in the same manner.

What is claimed is:

1. A connector adapted to be connected to a flexible conductor, the connector comprising:

a pushing member having a projection; and a contact made of a conductive material and having a projection accommodating portion of recess shape into which the projection is to be inserted, wherein the projection includes: a protruding portion that is situated in a lateral surface of the projection with protruding from the lateral surface of the projection and approaches an inner surface of the projection accommodating portion when the projection is inserted into the projection accommodating portion; and a gap forming portion that is situated in the lateral surface of the projection around the protruding portion and forms a predetermined gap between the gap forming portion and the inner surface of the projection accommodating portion when the projection is inserted into the projection accommodating portion, the predetermined gap being wider than a distance between the protruding portion and the inner surface of the projection accommodating portion, and wherein when the projection of the pushing member is inserted in the projection accommodating portion of the contact together with the flexible conductor with the flexible conductor being sandwiched between the projection and the projection accommodating portion of the contact such that the projection of the pushing member is covered by the flexible conductor, the protruding portion of the projection presses the flexible conductor against the inner surface of the projection accommodating portion to contact the flexible conductor to the inner surface of the projection accommodating portion, and a redundant portion of the flexible conductor generated upon being inserted into the projection accommodating portion is received in the predetermined gap.

2. The connector according to claim 1, wherein a dimension of the distance formed between the protruding portion and the inner surface of the projection accommodating portion when the projection is inserted in the projection accommodating portion is smaller than a thickness dimension of the flexible conductor.

3. The connector according to claim 1, wherein the projection is in a shape of a cylindrical column having a central axis and includes a plurality of the protruding portions arranged at equal intervals in a circumferential direction of the projection and a plurality of the gap forming portions each formed between every adjacent two of the plurality of the protruding portions.

4. The connector according to claim 3, wherein the projection has four protruding portions as the plurality of the protruding portions and four gap forming portions as the plurality of the gap forming portions.

5. The connector according to claim 4, wherein the inner surface of the projection accommodating portion of the contact has a shape of a cylindrical tube, and wherein the projection accommodating portion has an inside diameter smaller than a value obtained by adding a double of a thickness of the flexible conductor to a length between two of the four protruding portions of the projection protruding in opposite directions from each other.

6. The connector according to claim 3, wherein the protruding portion has a shape linearly extending in parallel with the central axis.

7. The connector according to claim 3, wherein the protruding portion has a spherical shape.

8. The connector according to claim 1, wherein the pushing member comprises a base member having a plurality of the projections, and wherein the plurality of the projections are separately inserted into the projection accommodating portions of a plurality of the contacts with a plurality of the flexible conductors being sandwiched therebetween.

9. The connector according to claim 8, wherein each of the plurality of the contacts has a tubular portion and a contact-side flange formed at one end of the tubular portion, wherein the connector further includes a housing having a plurality of contact through-holes through which the tubular portions of the plurality of the contact pass, each of the plurality of contact through-holes being smaller than the contact-side flange of each of the contacts, and wherein when the housing is fixed to the base member such that the tubular portions of the plurality of the contacts pass through the plurality of contact through-holes and the contact-side flanges of the plurality of the contacts are pressed against the base member, the plurality of the contacts are fixed to the base member.

10. The connector according to claim 9, wherein the base member has a housing fixing post projecting higher than the plurality of the projections, wherein the housing has a post accommodating portion of recess shape, and wherein the housing fixing post is accommodated in the post accommodating portion to fix the housing to the base member.

11. The connector according to claim 9, wherein the housing is made of an insulating material.

12. The connector according to claim 9, wherein the housing has a counter connector accommodating portion for accommodating a part of a counter connector.

13. The connector according to claim 8, wherein the base member is made of an insulating material.

14. The connector according to claim 1, wherein the pushing member has a pushing member-side flange joined to a root portion of the projection.

15. The connector according to claim 1, wherein the flexible conductor is disposed to be exposed on a top surface of an insulating substrate body, and wherein the flexible conductor is disposed between the pushing member and the contact such that the flexible conductor faces the projection accommodating portion of the contact and a bottom surface of the insulating substrate body faces the projection of the pushing member.

16. The connector according to claim 1, wherein the flexible conductor is independently disposed between the pushing member and the contact.

17. The connector according to claim 1, wherein a pointed portion for piercing the flexible conductor is formed at a tip of the projection.

18. The connector according to claim 1, wherein the contact is a plug-type contact.

19. The connector according to claim 1, wherein the contact is a receptacle-type contact.

* * * * *